United States Patent [19]

Moore

[11] 4,409,028

[45] Oct. 11, 1983

[54] PROCESS FOR PRODUCING CAST IRON

[76] Inventor: William H. Moore, Whitehall Apts.-6E, Whitehall Rd., Chattanooga, Tenn. 37405

[21] Appl. No.: 199,959

[22] Filed: Oct. 23, 1980

Related U.S. Application Data

[63] Continuation of Ser. No. 88,049, Oct. 24, 1979, abandoned.

[51] Int. Cl.[3] ..... C22C 33/08

[52] U.S. Cl. ..... 75/130 R; 75/53

[58] Field of Search ..... 75/53, 130 R

[56] References Cited

U.S. PATENT DOCUMENTS

| | | | |
|---|---|---|---|
| 2,747,990 | 5/1956 | Morrogh | 75/53 |
| 2,873,188 | 2/1959 | Bieniosek | 75/130 R |
| 3,598,383 | 8/1971 | Moore | 75/130 R |
| 3,598,573 | 8/1971 | Freissmuth | 75/53 |
| 3,640,702 | 2/1972 | Karinthi | 75/53 |
| 3,861,888 | 1/1975 | Heise | 75/53 |
| 3,876,421 | 4/1975 | Takemura | 75/53 |
| 3,955,973 | 5/1976 | Robinson | 75/130 R |
| 4,224,064 | 9/1980 | Bilek | 75/130 R |

FOREIGN PATENT DOCUMENTS

| | | | |
|---|---|---|---|
| 1258451 | 12/1971 | United Kingdom | 75/53 |

*Primary Examiner*—P. D. Rosenberg

*Attorney, Agent, or Firm*—Woodling, Krost & Rust

[57] ABSTRACT

A method of using a rare earth and carbon dioxide to control the quality and quantity of graphite in cast iron.

11 Claims, 2 Drawing Figures

PROCESS FOR PRODUCING CAST IRON

This is a continuation of application Ser. No. 88,049, filed Oct. 24, 1979 and now abandoned.

My invention relates to a method of controlling the degree of undercooling in various types of cast iron. Controlled undercooling is essential in the production of such cast irons as nodular cast iron, compacted flake cast iron, chilled irons and glass mold iron.

An object of the invention is to predictably control the structure of cast iron.

An object of the invention is to provide a means of eliminating coarse flake graphite in the structure of the cast iron.

My invention provides a means of more consistently producing compacted graphite in the structure of the cast iron.

Another object of my invention is to provide a means of more consistently producing nodular or spheroidal graphite in the structure of the cast iron.

A further object is to provide a means of providing a controlled quantity of undercooled graphite in chill cast irons.

A further object is to provide a means of more consistently producing cast irons used in the production of glass molds.

Still further objects may be apparent from the specification in which.

The control of the percentage of graphite is very important to the manufacture of cast iron for graphite is merely physically mixed with the iron instead of being in a chemical combination. Therefore, the percentage of graphite in the iron will greatly affect the tensile strength and other properties of the iron.

Graphite content in iron is normally controlled by the manipulation of the qualities of the base materials initially used in the production of the iron and by later additions of a nodularizer, usually cerium or magnesium.

It is with this latter method of control that my invention is concerned.

When a nodularizer, whether an alloy or in a pure form, is added to a melt cast iron, it first combines with the oxygen, nitrogen and sulphur present in the melt. If greater quantities are added the nodularizer then acts to change flake graphite into a compacted, nodular or spheroidal form depending on the amount added. This is the well known commercial method.

The problem in the manufacture of cast irons by this method is that the metal to which a nodularizer is added is seldom constant in sulphur, oxygen or nitrogen content. Often the nodularizer that is used up in combining with these elements is also unknown. This means that when a predetermined quantity of a nodularizer is added to a bath of molten metal, various quantities of active nodularizer are retained in the melt according to the aforesaid content of oxygen, nitrogen or sulphur. One cannot predict the quantity of the nodularizer available for interaction with the graphite. Graphite control is difficult without constant adjustments and measurements of the iron melt.

I have discovered that the effects of the nodularizer added to a molten cast iron may be controlled by bubbling carbon dioxide through said molten cast iron, leaving an iron with predictable qualities.

Figure 1:
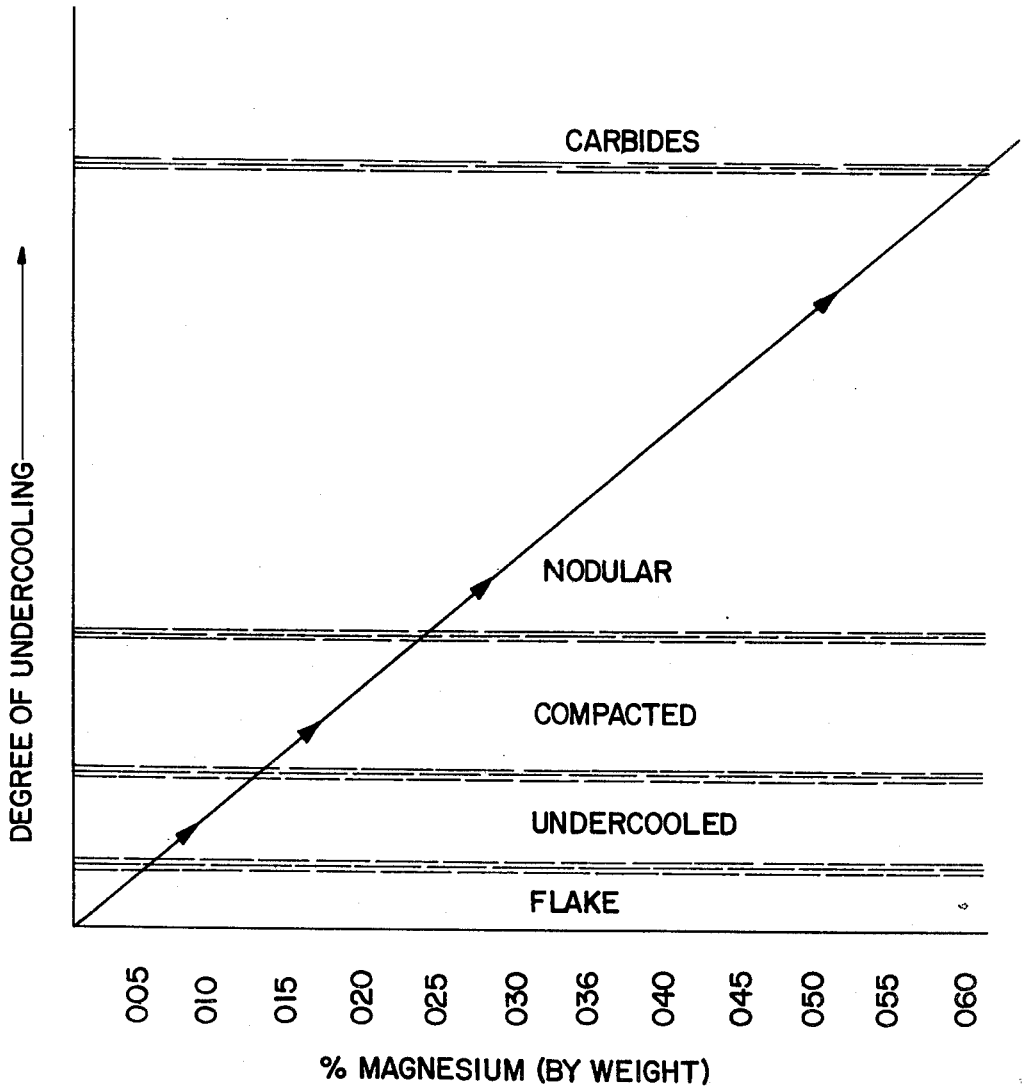
FIG. 1 is a chart representing the change in the nature of the graphite as increasing quantities of a nodularizer, in this case magnesium, are added to the melt.

The addition of a nodularizer to a bath of cast iron results in various changes taking place in the nature of the graphite in the cast iron depending on the quantity of the nodularizer available for interaction. These changes, together with an approximate nodularizer content, in this case magnesium, are depicted in the illustration of FIG. 1. At point "A" the metal contains coarse graphite. At point "B" the graphite becomes compacted and at point "C" it becomes predominantly nodular in form. At point "D" some of the graphite begins to occur as free carbide.

There is no sharp line demarcation between one type of graphite and the next. There is, instead, a gradual change in the relative quantity of each type of graphite present as the magnesium content is increased. The magnesium, by combining with various nuclei (silicates, oxides, sulphides, etc.) in the cast iron, produces a degree of undercooling. This effectively removes the normal flake graphite which occurs in cast iron because of the presence of these nuclei. As the magnesium content increases various structural changes take place.

At around 0.005% magnesium by weight a considerable quantity of undercooled type "A" graphite appears. At around 0.0 12 to 0.015% magnesium by weight, various quantities of compacted flake graphite begin to appear in the structure. At around 0.022 to 0.025% magnesium by weight, nodules of graphite begin to appear in the structure. If the magnesium content is increased beyond this point, the structure goes completely nodular, and eventually free carbides begin to appear in the structure.

The exact percentages of magnesium at which these changes will occur depend to some degree on the exact composition and condition of the base metal to which the magnesium is added. The lines on the graph in FIG. 1 indicate only roughly the percentages where these changes occur. I do not wish to be limited to specific type or quantities of nodularizer or nodularizing alloy to be added to a melt, as FIG. 1 is used only for the purpose of illustrating the changes that take place. The same sequence of events occur when a nodularizer such as cerium or rare earth is added.

It should be noted that the range of magnesium in which completely undercooled grahite can be produced is rather limited. Similarly the range of magnesium over which compacted flake graphite can be produced is also very narrow.

In practice, it is extremely difficult to produce either of these types of graphite by the use of magnesium or rare earth alone because of the fine degree of control that would be required.

I have discovered that if after the molten cast iron is treated with magnesium so that approximately 0.0 20% or more by weight of magnesium is retained, and if carbon dioxide is then bubbled through the melt, excess magnesium is removed so that approximately only 0.005% by weight is left. The structure of the graphite in the cast iron is completely of the undercooled variety.

While the same mechanism occurs if a rare earth is used instead of magnesium, I generally prefer to use magnesium because it is more volatile and easier to remove with carbon dioxide and because it has a considerably lower cost.

I have further discovered that this represents a good starting point for producing either compacted flake iron or nodular graphite iron, or alternatively, any cast iron in which a controlled amount of undercooled graphite is required in the structure.

For example, if the structure is first rendered completely undercooled by the process of my invention, and then a small quantity of magnesium or cerium or other rare earth metal is added to the metal of my invention, the structure may be rendered predominantly compacted.

On the other hand, if an increased quantity of magnesium or cerium or other rare earth metal is added, the structure may be rendered completely nodular.

If a quantity of sulphur is added to the metal of my invention, it is possible to produce coarse flake graphite in the structure as the undercooled graphite can be removed in part or completely as desired.

The process of my invention consists of adding an excess quantity of a nodularizer to and then bubbling carbon dioxide through the metal so as to produce a completely undercooled structure. This represents an ideal starting plateau from which various types of graphite may be produced in fixed and controllable quantity by making required later additions to the melt.

As an example of the working of my invention, I took a bath of gray cast iron and added magnesium ferrosilicon to it. The structure of a test piece taken from the metal was nodular and the magnesium content was 0.035% by weight (FIG. 2A).

I then bubbled carbon dioxide through the bath at the rate of 15 cubic feet per ton for a period of two minutes. The bubbling was done by means of a porous plug lance immersed in the bath. A test piece taken from the bath at this point showed an undercooled graphite (Type A) and a magnesium content of 0.006% (FIG. 2B).

The composition of the bath at this point was T.C. 3.53% by weight, Si. 2.30% by weight and sulphur 0.010% by weight.

I then subdivided the bath into two portions.

Figure 2:
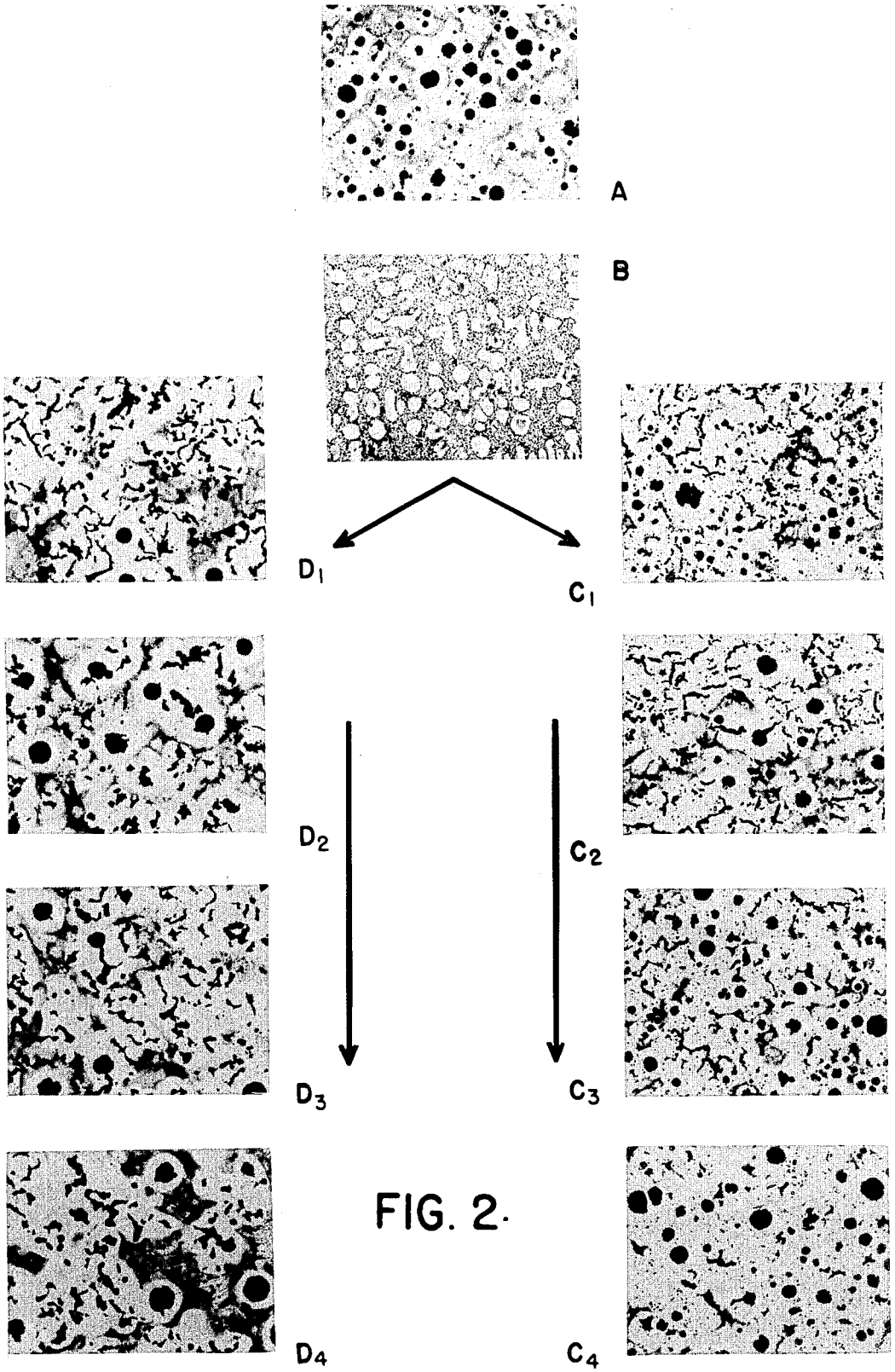
FIG. 2 shows a pictorial change in the type of graphite present before and after carbon dioxide bubbling of the melt and as increasing amounts of nodularizers are added thereafter.

I then took one portion of this bath "B", subdivided it into further portions, added various quantities of magnesium ferrosilicon to each portion, and cast a series of test pieces one inch in diameter. Each piece was examined under the microscope and the results are depicted in FIG. 2 by the photomicrographs C1, C2, C3 and C4. The magnesium content of these samples was 0.010, 0.015, 0.020 and 0.030% by weight respectively.

I then took the other portion of this bath "B", subdivided it into further portions, added various quantities of cerium ferrosilicon to each portion, and cast a series of test pieces of one inch in diameter. Each test piece was examined under the microscope, and the results are depicted in FIG. 2 by the photomicrographs D1, D2, D3 and D4. The amounts of cerium added to these portions was 0.02, 0.04, 0.06 and 0.08% by weight respectively.

It is evident from these test results that an addition of cerium from 0.02 to 0.06% by weight produced essentially compacted flake graphite. It is also evident that additions of magnesium alloy so as to retain up to about 0.02% by weight also produced essentially compacted flake graphite.

Also, I have found that additions of aluminum to the melt of about 0.5% by weight will improve the ability of cerium to produce the compacted form of graphite. I prefer to add thisaluminum immediately following the bubbling of carbon dioxide gas through the bath. In the same manner additives of titanium to the bath after bubbling carbon dioxide are somewhat useful in aiding the effect of magnesium.

Generally, I prefer to use cerium additions with or without aluminum because I find that they are considerably more predictable than magnesium additions.

I have found, also, that treatment of a cast iron bath with a nodularizer followed by an injection of carbon dioxide makes it considerably easier to make a fully nodular iron by further addition of the nodularizer. I find that nodular iron produced in this manner is considerably more consistent in both structure and nodularizer content.

Also, I have found that if I bubble carbon dioxide through a nodularizer containing cast iron melt, I can produce quantities of coarse flake graphite in the structure by bubbling for a longer time. This allows me to produce a controlled quantity of undercooled graphite alone with a controlled quantity of coarse graphite as well. I can further increase the quantity of coarse flake graphite by adding iron sulphide to the bath. I find this technique particularly useful when producing cast iron to be used in the manufacture of glass molds.

In making these articles, it is conventional to use chills in the sand molds in which they are cast to produce a surface containing undercooled graphite. I find this to be considerably easier when the bath is treated with magnesium and carbon dioxide prior to casting the glass molds.

Although this invention has been described in its preferred form with a certain degree of particularity, it is understood that the present disclosure of the preferred form has been made only by way of example and that numerous changes in the details may be resorted to without departing from the spirit and the scope of the invention as hereinafter claimed.

What is claimed is:

1. A method for controlling the graphite content in an iron melt comprising the steps of adding magnesium to the melt until more than 0.020% by weight of the melt is retained magnesium, bubbling the melt with carbon dioxide until the percentage of retained magnesium in the melt is around 0.005% by weight and then adding a nodularizer to the melt.

2. A method for producing a fully undercooled graphite structure comprising the steps of melting an iron charge having a flake graphite structure, adding an amount of a nodularizing agent to the melt greater than that necessary to deoxidize, desulfurize and to produce a substantially fully nodular graphite structure, thereafter adding a gas to the melt to remove active nodularizing agent to produce a substantially fully undercooled graphite structure.

3. A method for producing a substantially fully compacted flake structure comprising the additional step of taking the metal of claim 2 having a substantially fully undercooled graphite structure and adding thereto a nodularizing agent.

4. A method as claimed in claim 2 wherein said nodularizing agent is magnesium.

5. A method as claimed in claim 4 wherein said gas is $CO_2$.

6. A method as claimed in claim 3 wherein 0.5% by weight of aluminum is also added and said nodularizing agent is a rare earth element.

7. A method of producing a substantially fully undercooled graphite structure in a melt, comprising the steps of adding magnesium to the melt until more than 0.02% by weight of the melt is retained magnesium, bubbling the melt with a gas until the percentage of retained magnesium is around 0.005% by weight.

8. The method of claim 7 wherein the gas bubbled in the melt is carbon dioxide.

9. A method for producing a substantially fully compacted flake structure comprising the additional step of taking the metal of claim 2 or 7, having a substantially fully undercooled graphite structure and adding thereto magnesium so as to retain less than 0.02% magnesium in the melt.

10. A method for producing a substantially fully compacted flake structure comprising the additional step of taking the metal of claim 2 or 7, and adding thereto a rare earth element so as to retain less than 0.02% rare earth in the melt.

11. A method for producing a substantially fully compacted flake structure comprising the additional step of taking the metal of claim 2 or 7, and adding simultaneously aluminum in the amount of up to 0.5% by weight.

* * * * *